US007225745B2

(12) United States Patent
Schwerdlin et al.

(10) Patent No.: US 7,225,745 B2
(45) Date of Patent: Jun. 5, 2007

(54) FREE STANDING IRONING BOARD

(75) Inventors: Robert C. Schwerdlin, Bolingbrook, IL (US); Michael Jaron, Chicago, IL (US)

(73) Assignee: Home Products International, Inc., Chicago, IL (US)

( * ) Notice: Subject to any disclaimer, the term of this patent is extended or adjusted under 35 U.S.C. 154(b) by 286 days.

(21) Appl. No.: 10/841,763

(22) Filed: May 10, 2004

(65) Prior Publication Data

US 2005/0247242 A1 Nov. 10, 2005

(51) Int. Cl.
*A47B 3/02* (2006.01)

(52) U.S. Cl. ..... 108/118

(58) Field of Classification Search ..... 108/118, 108/119, 120, 115; 248/188.6, 439, 228.7; 38/137, 135, 138, 139, 103
See application file for complete search history.

(56) References Cited

U.S. PATENT DOCUMENTS

| | | | | | |
|---|---|---|---|---|---|
| 1,575,494 | A | | 3/1926 | Lavendier | |
| 1,721,044 | A | | 7/1929 | Klemm | |
| 1,963,977 | A | | 6/1934 | Flagstad | |
| 2,101,597 | A | | 12/1937 | Rich | |
| 2,424,734 | A | | 7/1947 | Booth | |
| 2,471,564 | A | * | 5/1949 | Gaudette | 108/118 |
| 3,106,296 | A | * | 10/1963 | Walsh et al. | 108/118 |
| 3,157,136 | A | * | 11/1964 | Moody | 108/118 |
| 3,206,881 | A | | 9/1965 | Kleinsorge | |
| 5,335,432 | A | | 8/1994 | Simpson | |
| 5,353,715 | A | * | 10/1994 | Luyk | 108/119 |
| 5,483,901 | A | * | 1/1996 | Tisbo et al. | 108/119 |
| 5,509,360 | A | * | 4/1996 | Chiu | 108/119 |
| 5,542,359 | A | * | 8/1996 | Polries | 108/119 |
| 5,848,822 | A | * | 12/1998 | Wu | 108/119 |
| 5,924,226 | A | | 7/1999 | Zuber | |
| D426,590 | S | | 6/2000 | Lan | |
| 6,253,472 | B1 | | 7/2001 | Gast | |
| 6,834,450 | B2 | * | 12/2004 | Gross et al. | 38/137 |
| 7,059,254 | B2 | * | 6/2006 | Strong et al. | 108/118 |

* cited by examiner

*Primary Examiner*—Jose V. Chen
(74) *Attorney, Agent, or Firm*—Neal Gerber & Eisenberg LLP

(57) ABSTRACT

An ironing board with scissor legs, one pivoted to the board. A leg support clip has a base member and a pair of flexible locking fingers, and the base member has a first portion engaging one side of a plate of a mounting member on the ironing board, and a second portion engaging the opposite plate side, with a connecting portion extending from the one plate side to the opposite plate side. The second portion also includes a leg spaced from the connecting portion with a locking member extending therefrom and received in a plate opening. The fingers extend away from the plate section and engage sides of the adjustable leg, and have outer ends spaced from the base member and spaced from one another a distance different than the spacing between the engaged sides of the adjustable leg to releasably lock the adjustable leg in a storage position adjacent the board bottom.

16 Claims, 6 Drawing Sheets

FREE STANDING IRONING BOARD

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention is directed toward ironing board structures, and particularly toward ironing boards having self supporting scissor leg configurations.

BACKGROUND OF THE INVENTION AND TECHNICAL PROBLEMS POSED BY THE PRIOR ART

Self standing ironing board structures are well known, including an ironing board on which clothes may be ironed to press out wrinkles and supporting legs. Typically, the supporting legs consist of a pair of legs pivotally secured at intermediate points in a scissors fashion, with one of the legs being pivotally secured to the underside of the ironing board and the other leg being adjustably secured to the ironing board. The legs may be selectively moved between a standing position in which the legs are generally X-shaped and a storage position in which the legs are generally parallel to one another and to the ironing board.

With some ironing boards, pivoting scissor legs have been provided with mechanisms to lock or selectively restrict the relative pivoting of the legs, with the mechanisms thereby used to secure the legs in their storage position. However, particularly after years of use, such mechanisms can undesirably hinder pivoting even when such pivoting is desired when changing the legs positions.

In other configurations, one leg is pivotally secured to the underside of the ironing board and the other leg has an end slidably secured to the underside of the ironing board, with sliding movement of the other leg being selectively limited to secure the legs in either the standing or storage position. However, the mechanisms by which the sliding movement of the other leg may be limited are also subject to undesirable binding when changing the leg positions.

In still other configurations, one leg is pivotally secured to the underside of the ironing board and the other leg is selectively secured to the ironing board only in the storage and standing positions, with the other leg being freely pivotable between positions. While such pivoting is simple, securing the other leg at each position may be problematic.

Further, while many different ironing board structures have been provided, among those different structures many common components are often used. For example, a single design of a ironing board may advantageously used by a manufacturer with many different supporting leg configurations. However, conversion between such different supporting legs may disadvantageously require many different components for each leg structure, including components on the common ironing board itself.

The present invention is directed toward overcoming one or more of the problems set forth above.

SUMMARY OF THE INVENTION

In one aspect of the present invention, a leg support clip is provided for an ironing board having an adjustable leg on its bottom and a mounting member with a plate section secured in spaced relationship from the board bottom with one side of the plate section facing the board, the plate section also having at least one opening therethrough. The leg support clip includes a base member and a pair of flexible locking fingers. The base member has a first portion adapted to engage the one side of the plate section, a second portion adapted to engage the opposite side of the plate section, and a connecting portion adapted to extend from the one plate section side to the opposite plate section side. The second portion includes a leg spaced from the connecting portion with a locking member extending from the second portion leg and adapted to be received in the plate section at least one opening. The locking fingers are adapted to extend away from the plate section and engage sides of the adjustable leg, and have outer ends spaced from the base member and spaced from one another a distance different than the spacing between the engaged sides of the adjustable leg. When the base member is secured to the plate section of the ironing board with the first portion engaging the one plate section side and the second portion engaging the opposite plate section side and the locking member received in the plate section at least one opening, the flexible locking fingers are adapted to releasably lock the adjustable leg in a selected position adjacent the board bottom.

In one form of this aspect of the invention, the adjustable leg consists of a pair of spaced leg members, and the locking finger ends are spaced apart a distance greater than the spacing between the leg members whereby the locking fingers are adapted to engage facing sides of the leg members when the adjustable leg is in the selected position adjacent the board bottom.

In another form of this aspect of the invention, the adjustable leg is a single leg member having an outer diameter, and the locking finger ends are spaced apart a distance less than the single leg member outer diameter whereby the locking fingers are adapted to engage opposite sides of the leg members when the adjustable leg is in the selected position adjacent the board bottom.

In still another form of this aspect of the invention, the locking member is adapted to be releasably secured in the plate section one opening.

In yet another form, the locking fingers are laterally spaced, and the base member first and second portions extend laterally from the fingers, the second portion leg extending in a non-linear angle from the second portion whereby the locking member is offset from the lateral direction of the base member first and second portions.

In still another form of this aspect of the present invention, the plate section has a thickness and includes a second opening therethrough, the base member first portion has a surface adapted to engage the plate section one side, the base member second portion has a surface facing opposite the first portion surface and adapted to engage the plate section opposite side, the first portion surface is substantially parallel to the second portion surface, the first and second portion surfaces are spaced apart substantially the thickness of the plate section; and the connecting portion is adapted to extend through the plate section second opening. In a further form, the plate section includes a flange along one edge with the plate section second opening being substantially adjacent the flange, and the base member first portion extends substantially parallel to and adjacent the plate section flange when the base member is secured to the plate section.

In yet another form of this aspect of the present invention, the connecting section extends between sides of the base member first and second portions, the second portion leg extends from the opposite side of the base member second portion, and the at least one opening in the plate section is spaced from an edge of the plate section. When the base member is secured to the plate section, the connecting potion is adjacent the edge of the plate section and the locking member is received in the at least one opening in the plate section.

In another aspect of the present invention, a self standing ironing board structure is provided, including an ironing board having a flat upper surface and a lower surface, first and second legs pivotally connected at an intermediate point of each leg with the first leg pivotally connected to the ironing board lower surface, a mounting member with a plate section secured in spaced relationship from the board lower surface with one side of the plate section facing the board lower surface, and a leg support clip. The first and second legs are pivotable between a standing position supporting the ironing board for ironing and a storage position with both of the legs substantially parallel to the ironing board. The leg support clip includes a base member and a pair of flexible locking fingers. The base member has a first portion engaging the one side of the plate section, a second portion engaging the opposite side of the plate section, and a connecting portion extending from the one plate section side to the opposite plate section side. The second portion includes a leg spaced from the connecting portion with a locking member extending from the second portion leg and secured in an opening in the plate section. A pair of flexible locking fingers extend away from the plate section and are adapted to releasably secure the second leg to the support clip when the legs are in the storage position.

In one form of this aspect of the present invention, the locking fingers are laterally spaced, and the base member first and second portions extend laterally from the fingers, with the second portion leg extending in a non-linear angle from the second portion whereby the locking member is offset from the lateral direction of the base member first and second portions.

In another form of this aspect of the invention, the locking member is adapted to be releasably secured in the plate section opening.

In still another form of this aspect of the invention, the plate section has a thickness and includes a second opening therethrough, the base member first portion has a surface engaging the plate section one side, the base member second portion has a surface facing opposite the first portion surface and engaging the plate section opposite side, the first portion surface is substantially parallel to the second portion surface with the first and second portion surfaces being spaced apart substantially the thickness of the plate section, and the connecting portion extends through the plate section second opening.

In yet another form of this aspect of the present invention, the locking fingers engage sides of the second leg when the legs are in the storage position, with the locking fingers having outer ends spaced from the base member and spaced from one another a distance different than the spacing between the engaged sides of the adjustable leg.

In a further form, the plate section includes a flange along one edge, and a second opening substantially adjacent the flange. The second leg selectively comprises either a single leg member or a pair of spaced leg members; and the leg support clip comprises a selected one of two different support clips. The first leg support clip is selected when the second leg is a single leg member, and has the base member first portion extending substantially parallel to and adjacent the plate section flange when the base member is secured to the plate section, with the locking finger ends spaced apart a distance greater than the single leg member outer diameter, whereby the locking fingers are adapted to engage opposite sides of the leg members when the adjustable leg is in the storage position. The second leg support clip is selected when the second leg is a pair of spaced leg members, with the connecting section extending between sides of the base member first and second portions, the connecting section being adjacent an edge of the plate section opposite the one edge, and the second portion leg extending from the opposite side of the base member second portion. The locking finger ends of the second clip are spaced apart a distance greater than the spacing between the leg members whereby the locking fingers are adapted to engage facing sides of the leg members when the second leg is in the storage position.

In a still further form, the locking fingers of the first leg support clip are laterally spaced, and the first and second portions of the base member of the first leg support clip extend laterally from the fingers with the second portion leg extending in a non-linear angle from the second portion whereby the locking member is offset from the lateral direction of the base member first and second portions.

In yet another form of the present invention, the first and second legs each comprise a pair of parallel leg members, the leg members of the second leg being pivotally secured between the leg members of the first leg. In a further form, the first leg is pivotally secured to the ironing board lower surface at one end of the ironing board, and the mounting member is secured to the ironing board lower surface at the one end of the ironing board. In a still further form, the mounting member is secured to the ironing board lower surface at a position substantially adjacent the axis of pivot between the first leg and the ironing board lower surface.

In still another form of this aspect of the present invention, the first leg is pivotally secured to the ironing board lower surface at one end of the ironing board, and the mounting member is secured to the ironing board lower surface at the other end of the ironing board.

DETAILED DESCRIPTION OF THE INVENTION

Figure 1:
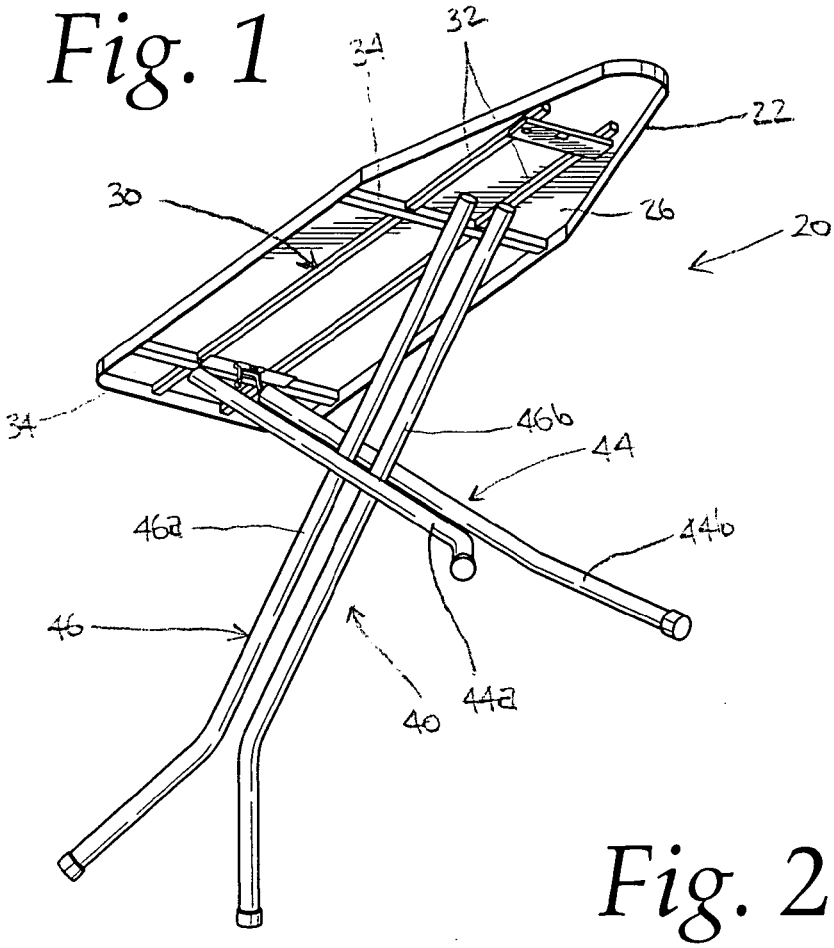
FIG. 1 is a perspective view from beneath an ironing board structure according to one embodiment of the present invention, with the legs in the standing position.
Figure 2:
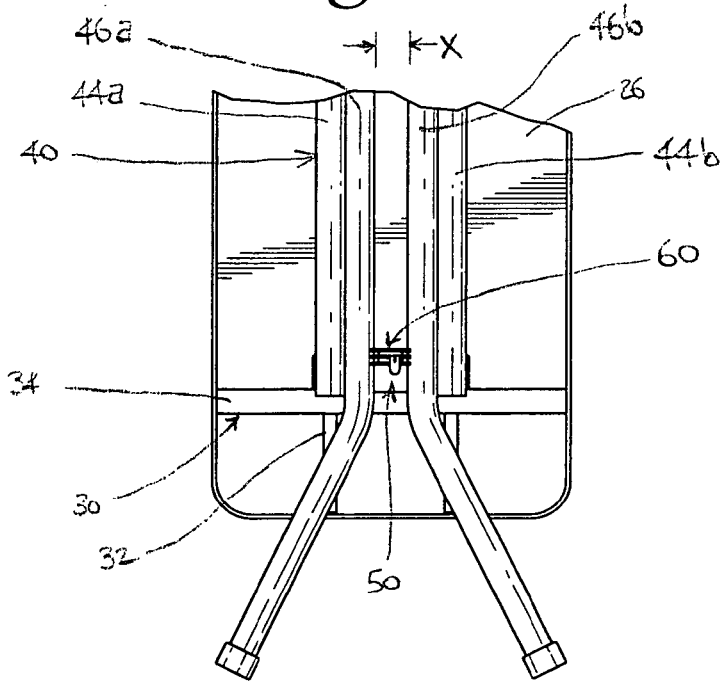
FIG. 2 is a partial bottom plan view of the FIG. 1 embodiment, showing the legs in the storage position.

FIGS. 1–8 illustrate an ironing board structure 20 according to a first embodiment of the present invention. As best seen in FIG. 1, the structure 20 includes an ironing board 22 having a suitable upper surface (not shown in the Figures) on which clothes and other articles may be suitably pressed to remove wrinkles such as is well known.

The ironing board lower surface 26 may have a suitable bracing structure 30 secured thereto, with the illustrative bracing structure 30 shown in the figures including two spaced longitudinal braces 32 and two spaced cross braces 34. A scissors-type leg structure 40 may be advantageously secured to the ironing board 22 as described in further detail below. The braces 32, 34 may provide structural strength to assist in keeping the ironing board 22 flat such as is desired through its expected long useful life, and further may be used to facilitate connection of the leg structure 40 to the ironing board 22 as described below. It should be understood, however, that the present invention may be used with an ironing board 22 which does not have a bracing structure, or which has a virtually any other bracing structure in addition to the particular bracing structure 30 shown in FIG. 1.

The leg structure 40 consists of a pair of legs 44, 46, with each of the legs 44, 46 consisting of a pair of parallel leg members 44*a*, 44*b* and 46*a*, 46*b* in the FIGS. 1–8 embodiment. The first leg 44 may be advantageously pivotally secured at one end to the ironing board 22 in any suitable manner, The two legs 44, 46 may also be pivotally secured at an intermediate point along their lengths in any suitable manner whereby the two legs 44, 46 may be readily pivoted relative to one another between the standing or supporting position shown in FIG. 1 and the storage position shown in FIG. 2 as further described below. Further, the leg members 46*a*, 46*b* of the second leg 46 may be advantageously pivotally secured between the leg members 44*a*, 44*b* of the first leg 44. Spacers (not shown) may also be provided at selected points between the leg members 44*a*, 44*b* and 46*a*, 46*b* of each leg 44, 46 to secure the leg members 44*a*, 44*b* and 46*a*, 46*b* in the desired parallel orientation. It will be appreciated that spacers, if any, provided between the leg members 44*a*, 44*b* of the first leg 44 should be located so as to not interfere with the positioning of the second leg 46 in the overlapping storage position as described below. The facing sides of the two leg members 46*a*, 46*b* of the second leg 46 are spaced apart a distance X (See FIG. 2).

A suitable releasable connection is also provided between the second leg 46 and the ironing board 22 when in the standing position.

The leg members 44*a*, 44*b* and 46*a*, 46*b* may also be flared outwardly away from one another at their lower ends to provide a stable wide supporting base for the ironing board structure 20 when in use.

In accordance with the present invention, a mounting member 50 is suitably secured to the ironing board 22 (either directly or through connection to the bracing structure 30). The mounting member 50 includes a plate section 52 with a flange 54 along one edge at substantially right angles to the plate section 52. As secured to the ironing board 22, the plate section 52 may be advantageously spaced from the bottom surface of the ironing board 22, with the flange 54 extending toward the ironing board 22 to provide rigidity to the plate section 52 as well as to assist in ensuring the advantageous spacing desired between the plate section 52 and the ironing board 22.

In accordance with the FIGS. 1–8 embodiment, the mounting member 50 may include an opening (not sown) generally centrally located between the sides of the plate section 52 and spaced from the edge of the plate section 52 opposite the edge having the flange 54.

Figure 3:
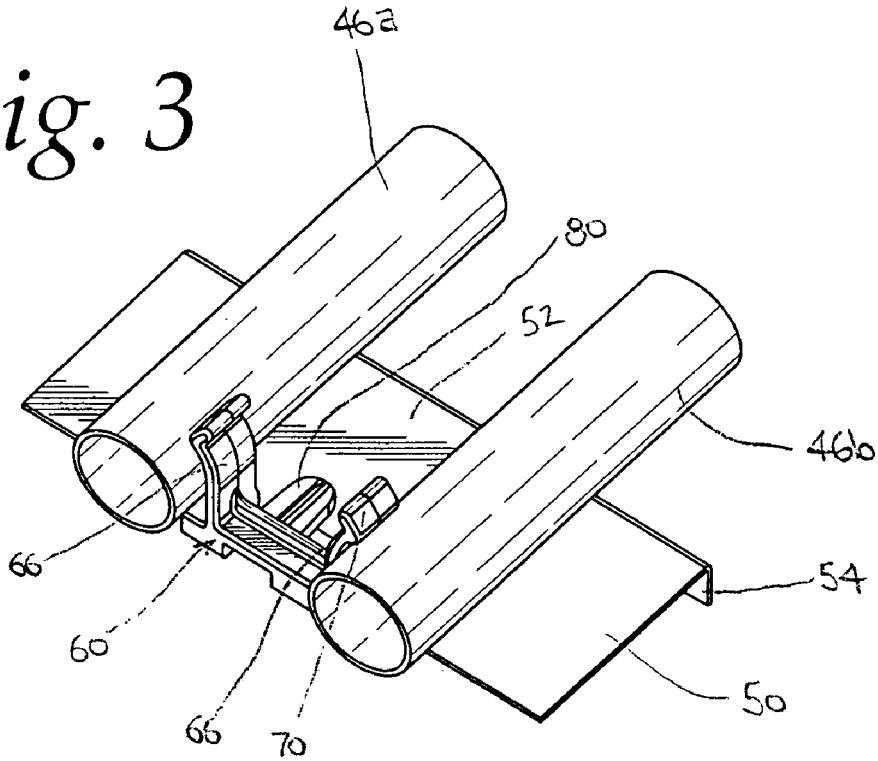
FIG. 3 is a detailed perspective view showing the leg support of the FIG. 1 embodiment supporting a leg.

A leg support clip 60 is secured to a mounting member 50 at the edge opposite the flange 54, as illustrated best in FIG. 3 and as described in greater detail below. The leg support clip 60 includes a base member 62 suitably securable to the plate section 52 (as described below), and a pair of flexible locking fingers 66 extending away from the plate section 52. The locking fingers 66 advantageously have outer ends 68 which extend outwardly in an unflexed condition to points which spaced apart from one another a distance Y (see FIG. 6), where Y is greater than X. Further, the outer ends 68 may include inwardly tapered cam ends 70.

With the above dimensions, it should be appreciated that when the leg members 46*a*, 46*b* are moved to the storage position, they will engage opposite outer sides of the cam ends 70 such that pushing the leg members 46*a*, 46*b* further will apply a biasing force to flex the locking fingers 66 together. Once the leg members 46*a*, 46*b* move past the outer ends 68, the locking fingers 66 will flex back out to their normal position, with the outer ends 68 spaced apart Y and thereby releasably blocking the leg members 46*a*, 46*b* (which are spaced apart only X) in the storage position of FIGS. 2 and 3.

The clip base member 62 is U-shaped with a connecting portion 74 between two flat portions 76, 78, where the two flat portions 76, 78 are spaced apart substantially the thickness of the plate section 52 of the mounting member 50. The connecting portion extends along one edge of the upper flat portion 76 (in the FIGS. 3–8 orientation) and a leg 80 projects beyond the opposite side of the upper flat portion 76. Being advantageously made of the same suitable material as the flexible locking fingers 66, the base member 62, including the leg 80, may elastically flex during assembly.

Figure 4:
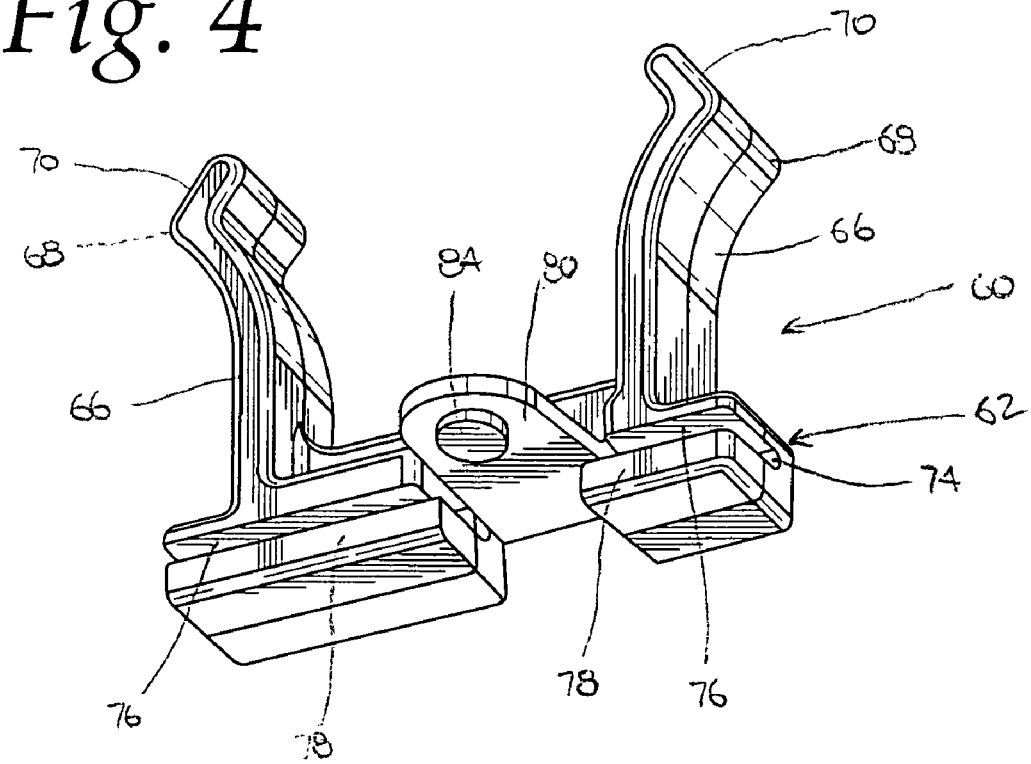
FIG. 4 is a perspective view of the leg support clip of the FIG. 1 embodiment.
Figure 5:
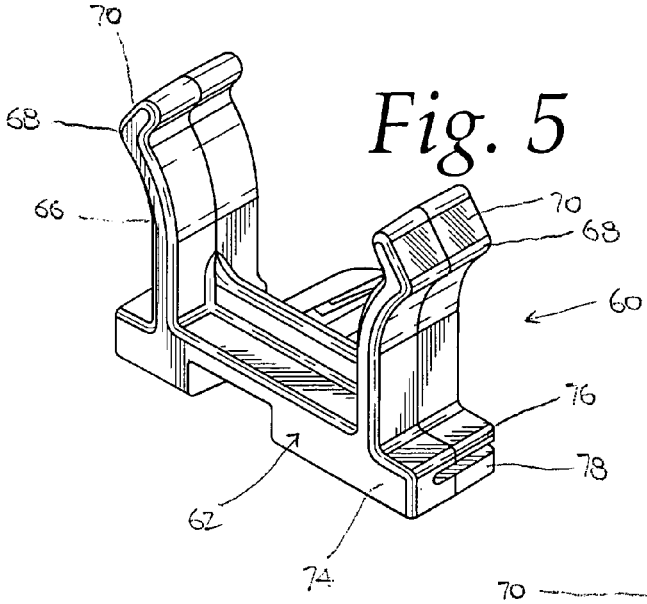
FIG. 5 is another perspective view showing the leg support clip from the opposite angle of FIG. 4.
Figure 6:
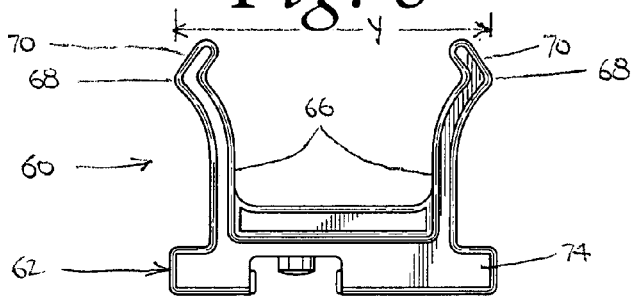
FIG. 6 is au upright view of the leg support clip of FIGS. 4–5.
Figure 7:
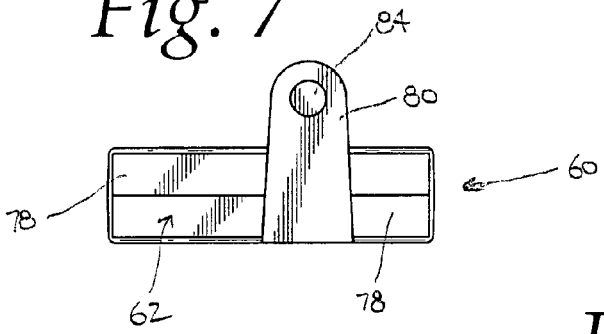
FIG. 7 is a bottom view of the leg support clip of FIGS. 4–5.
Figure 8:
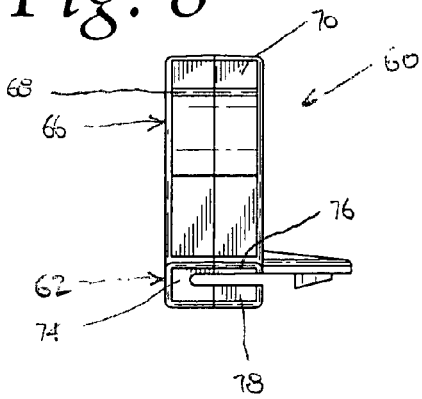
FIG. 8 is a side view of the leg support clip of FIGS. 4–5.
Figure 9:
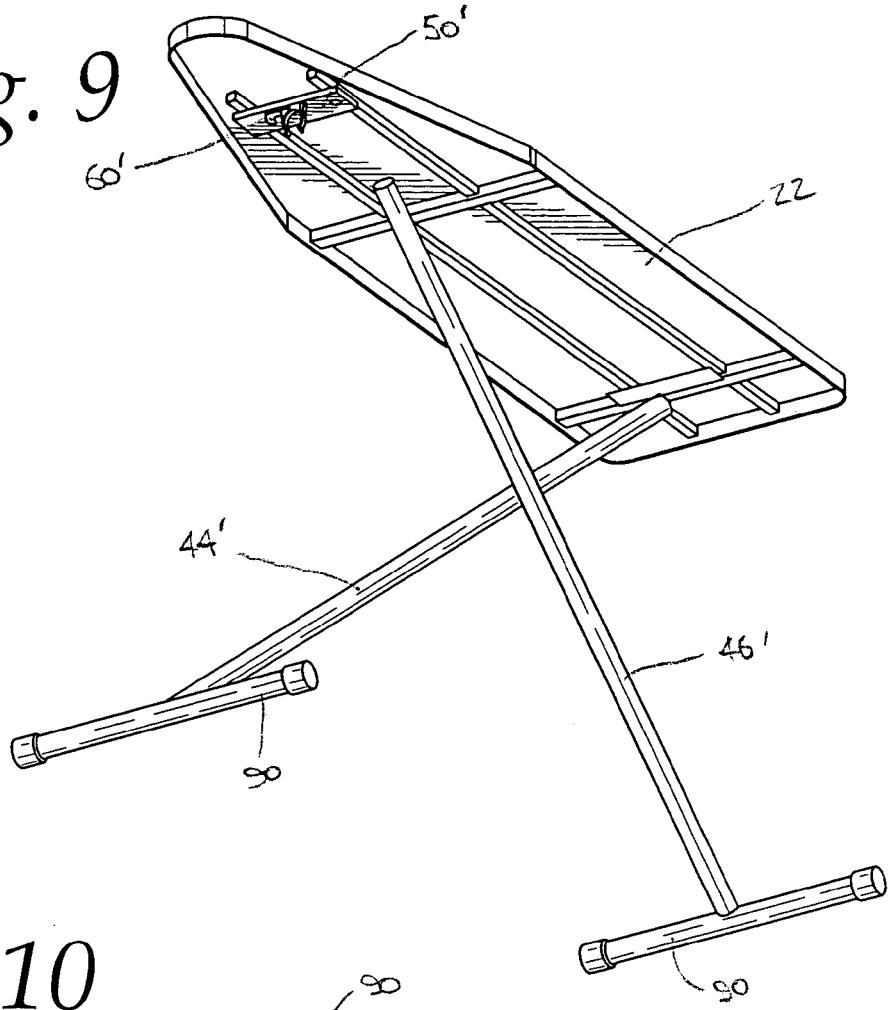
FIG. 9 is a perspective view from beneath an ironing board structure according to a second embodiment of the present invention, with the legs in the standing position.
Figure 10:
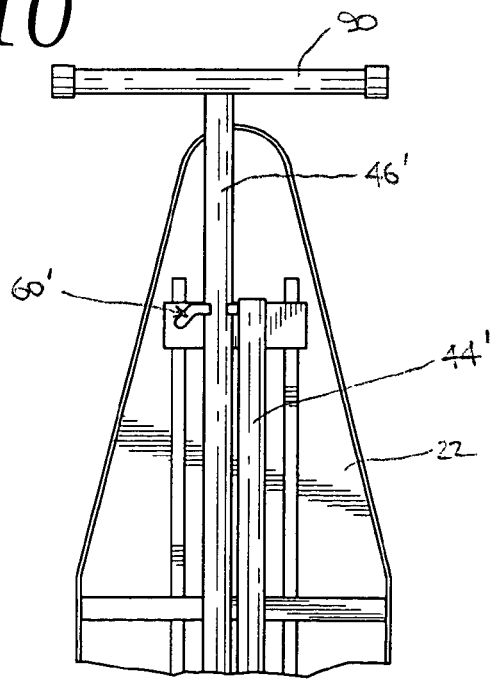
FIG. 10 is a partial bottom plan view of the FIG. 9 embodiment, showing the legs in the storage position.

As can be seen particularly in FIG. 4, the lower flat portion 78 may consist of two different parts, to facilitate molding of the leg support clip 60 with the extending leg 80.

A locking member 84 extends down from the leg 80 (i.e., in the same direction as the connecting member from the flat portion 76). The locking member 84 is oriented so as to be aligned with the plate section opening when the base member 62 is in the desired position, with the upper flat portion 76 adjacent one side of the plate section 52, the other flat portion 78 between the plate section 52 and the ironing board 22 and adjacent the other side of the plate section 52, and the connecting portion 74 adjacent the edge of the plate section 52.

It should thus be appreciated that the base member 62 may be readily assembled on the mounting member 50 by sliding it onto the plate section 52, with the leg 80 flexing up as the locking member 84 slides over the plate section 52 until in the desired position, in which the leg 80 will flex back down to snap the locking member 84 down into the mounting member opening when they are aligned in the desired connected position. The base member 62 will thus be securely retained on the mounting member 50 for the useful life of the ironing board structure 20. However, should it thereafter be necessary to replace the leg support clip 60 for any reason (including repair if, e.g., one of the locking fingers 66 were to break), the base member 62 may still be readily removed by sliding a sharp object such as a knife or screwdriver between the leg 80 and the plate section 52 to flex the leg 80 up to clear the locking member 84 from the mounting member opening.

A second embodiment of the present invention is shown in FIGS. 9–15, in which identical components to those in the first described embodiment are given the same reference numerals, and similar but modified components are given the same reference numerals with prime ("") added.

In this second embodiment, the ironing board 22 is supported by a leg structure 40', wherein each leg 44', 46' consists of a single tubular member, each having a transverse foot 90 secured to the bottom ends.

In accordance with this embodiment, the leg support clip 60' is suitably secured to a mounting member 50' having a plate member 52' and a flange 54' such as previously described. The mounting member 50' is secured to the ironing board 22 at the opposite end from the pivotal connection between the first leg 44' and the ironing board 22.

Figure 11:
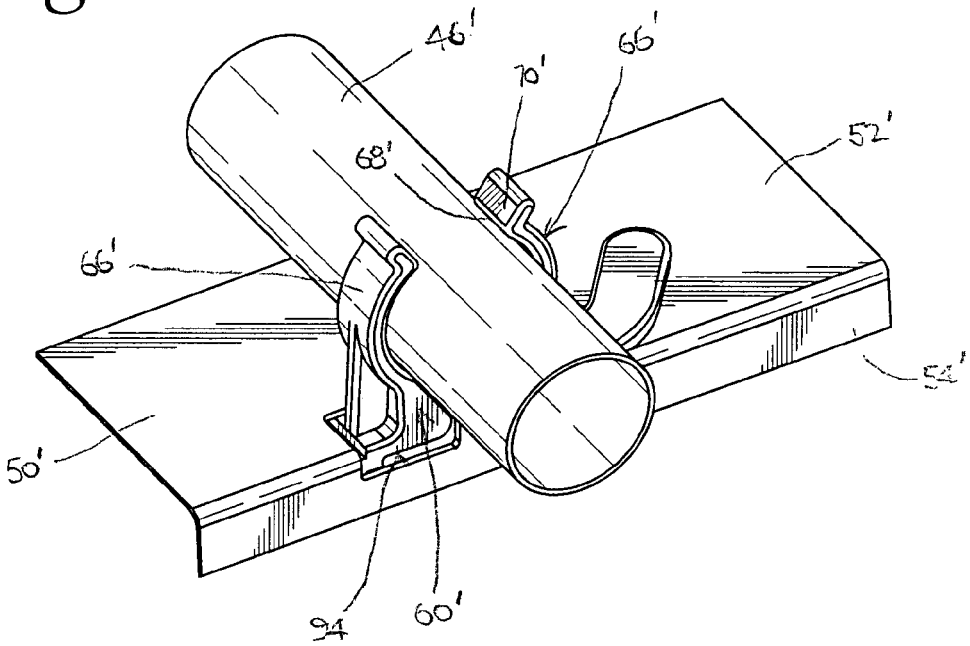
FIG. 11 is a detailed perspective view showing the leg support of the FIG. 11 embodiment supporting a leg.
Figure 12:
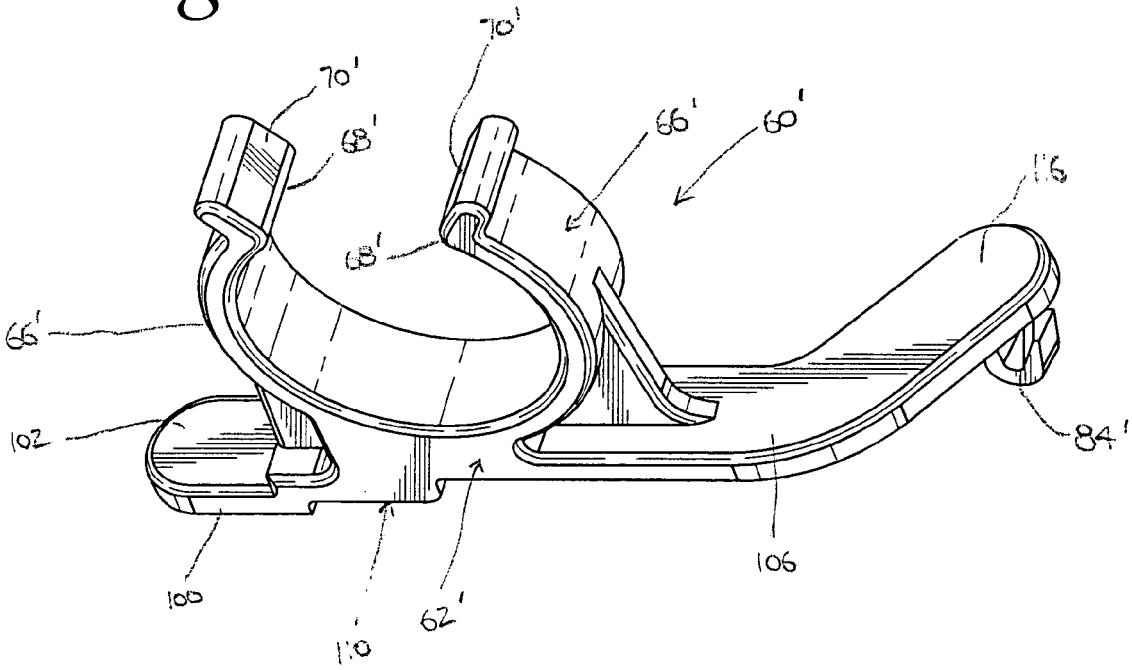
FIG. 12 is a perspective view of the leg support clip of the FIG. 12 embodiment.
Figure 13:
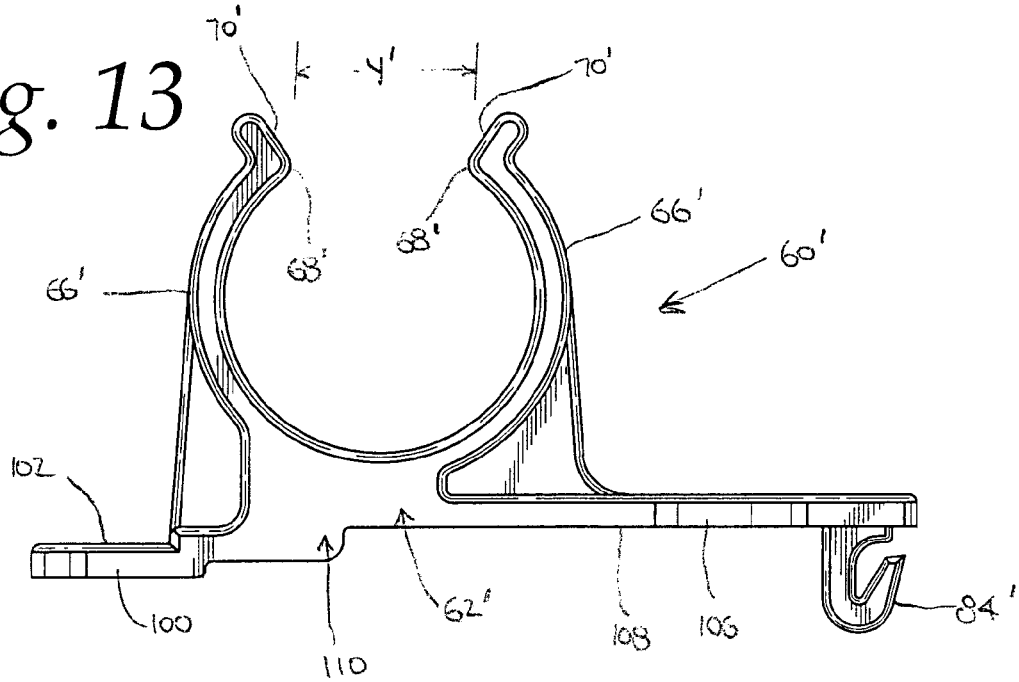
FIG. 13 is an upright view of the leg support clip of FIGS. 11–12.
Figure 14:
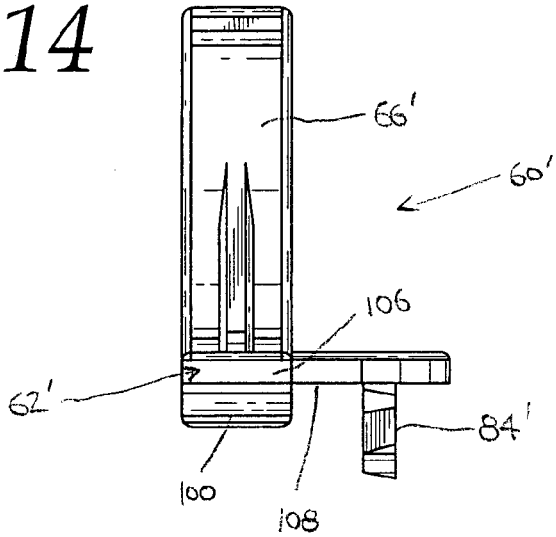
FIG. 14 is a side view of the leg support clip of FIGS. 11–12.

The plate section 52' of the mounting member 50' includes a pair of openings, one opening 94 (see FIG. 11) adjacent the flange 54' and one spaced from the flange edge and off center between the sides of the plate section 52' for a purpose as described below. As shown in FIG. 11, the opening 94 may extend partially into the flange 54'.

The leg support clip 60' includes a base member 62' suitably securable to the plate section 52' (as described below), and a pair of flexible locking fingers 66' extending away from the plate section 52'. The locking fingers 66' advantageously have outer ends 68' which extend inwardly in an unflexed condition to points which spaced apart from one another a distance Y' (see FIG. 13), where Y' is less than the diameter of the second leg 46'. Further, the outer ends 68 may include outwardly tapered cam ends 70'.

With the above dimensions, it should be appreciated that when the leg 46' is moved to the storage position, it will engage opposite outer sides of the cam ends 70' such that pushing the leg 46' further will apply a biasing force to flex the locking fingers 66' apart, allowing the leg 46' to pass therebetween. Once the leg 46' moves past the outer ends 68', the locking fingers 66' will flex back together to their normal position, with the outer ends 68' spaced apart Y' and thereby releasably blocking the leg 46' in the storage position of FIGS. 10 and 11.

The clip base member 62' includes a first portion 100 adapted to fit through the opening 94 in the plate section 52' to be disposed between the plate section 52' and the ironing board 22. The base member first portion 100 includes a first surface 102 which is adjacent the lower surface of the plate section 52' (in the FIG. 11 orientation) when secured thereto. The base member 62' also includes a second portion 106 which extends laterally from the fingers 66' in the opposite direction of the first portion 100 and has a second, oppositely facing surface 108 which is adjacent the upper surface of the plate section 52' (in the FIG. 11 orientation) when secured thereto. The first and second surfaces 102, 108 are substantially parallel and spaced apart a distance substantially equal to the thickness of the plate section 52'.

A stepped portion 110 connects the first and second portions 100, 106 of the base member 62'. When positioned in the plate section opening 94 as shown in FIG. 11, one finger 66' will abut one end of the opening 94 and the step between the stepped portion 110 and the second portion 106 will abut the other end of the plate section opening 94 to assist in keeping the leg support clip 60' in the desired orientation.

Figure 15:
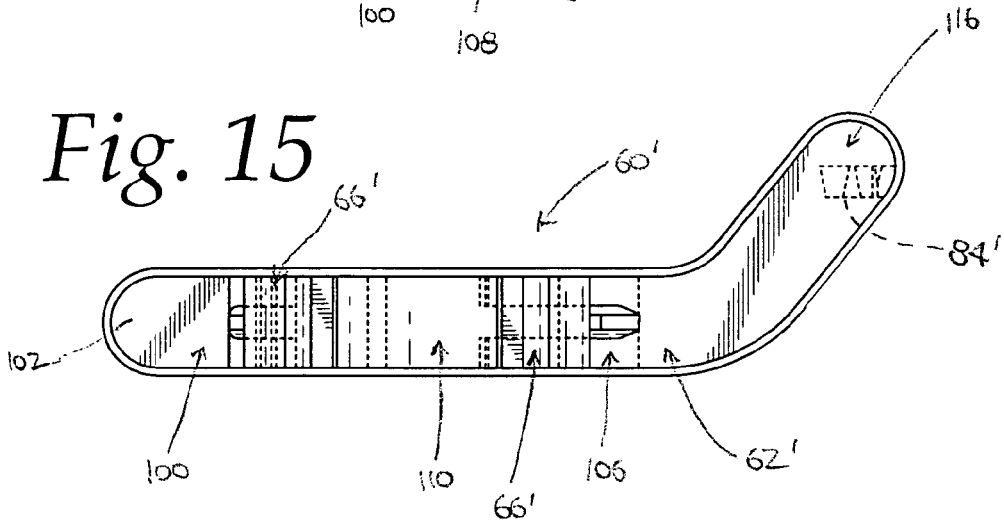
FIG. 15 is a top view of the leg support clip of FIGS. 11–12.

The base member second portion 106 also includes a leg 116 which extends at a non-linear angle from the second portion 106, for example at a 45 degree angle as illustrated in FIG. 15. Offset from the lateral direction of the base member first and second portions 100, 106 on the leg 116 is a locking member 84' extending downwardly (in the FIGS. 11–14 orientation) at a location which will be aligned with the other plate section opening when the base member 62' is in the desired position, with the first portion 100 adjacent the bottom side of the plate section 52' (between the plate section 52' and the ironing board 22), the second portion 106 adjacent the other (upper) side of the plate section 52', and the connecting portion 74 extending through the opening 94. When secured therein, the first portion 100 is adjacent the corner defined by the plate section 52' and the flange 54', whereby the abutment therebetween assists in ensuring that the clip 60' be securely retained in the desired position without undesirable twisting.

It should thus be appreciated that the base member 62' may be readily assembled on the mounting member 50' by angling the first section 100 down and moving it through the opening 94 until the stepped portion 110 is located in the opening 94. At that point, the base member 62' is pivoted down, bringing the first portion 100 up against the underside of the plate section 52' and the second portion 106 down toward the top of the plate section 52' (in the FIG. 11 orientation). As this pivoting occurs, the locking member 84' will be aligned with the second opening in the plate and snapped into the opening to releasably secure the locking member therein. For example, the locking member 84' may comprise a flexible hook (see FIG. 13) having the end of the hook spaced from the second portion leg 116 at least about the thickness of the plate section 52'. Therefore, the locking member 84' may be pushed through the opening and, when fully extending therethrough, the end of the hook will snap out of the opening so as to interfere with the underside of the plate section 52' and thereby releasably secure the base member 62' in the desired position. Should it thereafter be necessary to replace the leg support clip 60' for any reason, the base member 62' may still be readily removed by squeezing the hook shape together on the underside of the plate section 52' to allow the locking member 84' to be pushed back up through the opening.

It should be appreciated that the above embodiments, in addition to their advantageous structural features, may also be advantageously used in the manufacture of ironing board structures. For example, ironing boards with a bracing structure such as described may be used with both of the above embodiments. Further, a single design mounting member may also be secured with such ironing boards and bracing structures, with three appropriately located openings such as described above provided in the plate section (with only those openings required for connecting the selected leg support clip being used with a selected structure). Either leg design and/or leg lock clip may therefore be advantageously used with the same base ironing board/bracing structure, thereby reducing the different assembly/manufacture steps required for the different designs, and thereby also reducing inventory requirements.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

The invention claimed is:

1. A leg support clip adapted for use with an ironing board having an adjustable leg on its bottom and a mounting member with a plate section secured in spaced relationship from the board bottom with one side of said plate section facing said board, said plate section also having at least one opening therethrough, said leg support clip comprising:

a base member having a first portion adapted to engage said one side of said plate section, a second portion adapted to engage the opposite side of said plate section, and a connecting portion adapted to extend from said one plate section side to said opposite plate section side, said second portion including a leg spaced from said connecting portion with a locking member extending from said second portion leg and adapted to be received in said plate section at least one opening; and a pair of flexible locking fingers adapted to extend away from said plate section and engage sides of the adjustable leg, said locking lingers having outer ends spaced from said base member and spaced from one another a distance different than the spacing between the engaged sides of the adjustable leg;

whereby when said base member is secured to the plate section of the ironing board with said first portion engaging said one plate section side and said second portion engaging said opposite plate section side and said locking member received in said plate section at least one opening, said flexible locking fingers are adapted to releasably lock the adjustable leg in a selected position adjacent the board bottom.

2. The device of claim 1, wherein said adjustable leg comprises a pair of spaced leg members, and said locking finger ends are spaced apart a distance greater than the spacing between the leg members whereby said locking fingers are adapted to engage facing sides of said leg members when said adjustable leg is in said selected position adjacent the board bottom.

3. The device of claim 1, wherein said adjustable leg comprises a single leg member having an outer diameter, and said locking finger ends are spaced apart a distance less than said single leg member outer diameter whereby said locking fingers are adapted to engage opposite sides of said leg members when said adjustable leg is in said selected position adjacent the board bottom.

4. The device of claim 1, wherein said locking member is adapted to be releasably secured in said plate section one opening.

5. The device of claim 1, wherein said locking fingers arc laterally spaced, and said base member first and second portions extend laterally from said fingers, said second portion leg extending in a non-linear angle from said second portion whereby said locking member is offset from said lateral direction of said bass member first and second portions.

6. The device of claim 1, wherein:

said connecting section extends between sides of said base member first and second portions;

said second portion leg extends from the opposite side of the base member second portion; and said at least one opening in said plate section is spaced from edge of said plate section;

whereby when said base member is scoured to said plate section, said connecting potion is adjacent said edge of said plate section and said locking member is received in said at least one opening in the plate section.

7. A self standing ironing board structure, comprising:

an ironing board having a flat upper surface and a lower surface:

first and second legs pivotally connected at an intermediate point of each leg said first leg being pivotally connected to said ironing board lower surface and said first and second legs being pivotable between a standing position supporting the ironing board for ironing and a storage position with both of said legs substantially parallel to said ironing board;

a mounting member with a plate section secured in spaced relationship from the board lower surface with one side of said plate section facing said board lower surface, said plate section also having at least one opening therethrough; and a leg support clip including a base member having a first portion engaging said one side of said plate section, a second portion engaging the opposite side of said plate section, and a connecting portion extending from said one plate section side to said opposite plate section side, said second portion including a leg spaced from said connecting portion with a locking member extending from said second portion leg and secured in said plate section at least one opening; and a pair of flexible locking fingers extending away from said plate section and adapted to releasably secure said second leg to said support clip when said legs are in said storage position.

8. The ironing board structure of claim 7, wherein said locking fingers are laterally spaced, and said base member first and second portions extend laterally from said fingers, said second portion leg extending in a non-linear angle from said second portion whereby said locking member is offset from said lateral direction of said base member first and second portions.

9. The ironing board structure of claim 7, wherein said locking member is adapted to be releasably secured in said plate section one opening.

10. The ironing board structure of claim 7, wherein said locking fingers engage sides of the second leg when said legs are in said storage position, said locking fingers having outer ends spaced from said base member and spaced from one another a distance different than the spacing between the engaged sides of the adjustable leg.

11. The ironing board structure of claim 10, wherein:

said plate section includes a flange along one edge, and a second opening substantially adjacent said flange;

said second leg selectively comprises either a single leg member or a pair of spaced leg members; and said leg support clip comprises a selected one of either a first leg support clip when said second leg selectively comprises said single leg member, said first leg support clip having said base member first portion extending substantially parallel to and adjacent said plate section flange when said base member is secured to said plate section, and said locking fingers ends spaced apart a distance greater than said single leg member outer diameter, whereby said locking fingers are adapted to engage opposite sides of said leg members when said adjustable leg is in said storage position, and a second leg support clip when said second leg selectively comprises said pair of spaced leg members, said second leg support clip having said connecting section extending between sides of said base member first and second portions, said connecting section being adjacent an edge of said plate section opposite said one edge, said second portion leg extending from the opposite side of the base member second portion, and said locking finger ends spaced apart a distance greater than a the spacing between the leg members whereby said locking fingers are adapted to engage facing sides of said leg members when said second leg is in said storage position.

12. The ironing board structure of claim 11, wherein said locking fingers of said first leg support clip are laterally spaced, and said first and second portions of said base member of said first leg support clip extend laterally from said fingers with said second portion leg extending in a nonlinear angle from said second portion whereby said locking member is offset from said lateral direction of said base member first and second portions.

13. The ironing board structure of claim 7, wherein said first and second legs each comprise a pair of parallel leg members, said leg members of said second leg being pivotally secured between said leg members of said first leg.

14. The ironing board structure of claim 13, wherein said first leg is pivotally secured to said ironing board lower surface at one end of said ironing board, and said mounting member is secured to said ironing board lower surface at said one end of said ironing board.

15. The ironing board structure of claim 14, wherein said mounting member is secured to said ironing board lower surface at a position substantially adjacent the axis of pivot between said first leg and said ironing board lower surface.

16. The ironing board structure of claim 7, wherein said first leg is pivotally secured to said ironing board lower surface at one end of said ironing board, and said mounting member is secured to said ironing board lower surface at the other end of said ironing board.

* * * * *

UNITED STATES PATENT AND TRADEMARK OFFICE

CERTIFICATE OF CORRECTION

PATENT NO. : 7,225,745 B2
APPLICATION NO. : 10/841763
DATED : June 5, 2007
INVENTOR(S) : Robert C. Schwerdlin and Michael Jaron It is certified that error appears in the above-identified patent and that said Letters Patent is hereby corrected as shown below:

Column 9, Line 32 delete “lingers” and replace with --fingers--.

Column 9, Line 61 delete “arc” and replace with --are--.

Column 9, Line 66 delete “bass” and replace with --base--.

Column 10, Line 8 delete “scoured” and replace with --secured--.

Signed and Sealed this

Fourteenth Day of August, 2007

JON W. DUDAS
*Director of the United States Patent and Trademark Office*